US005154515A

United States Patent [19]

Haynes

[11] Patent Number: 5,154,515

[45] Date of Patent: Oct. 13, 1992

[54] TOESLING GAME-BALLOON AND BASEBALL LAUNCHER

[76] Inventor: Willard S. Haynes, P.O. Box 241, Doyle, Calif. 96109

[21] Appl. No.: 395,511

[22] Filed: Aug. 18, 1989

[51] Int. Cl.[5] ..... F41B 3/02

[52] U.S. Cl. ..... 124/20.1; 124/17

[58] Field of Search ..... 124/17, 20 R, 21, 20 B, 124/22, 20.1, 20.3, 16; D21/2; 446/26, 429

[56] References Cited

U.S. PATENT DOCUMENTS

| | | | |
|---|---|---|---|
| D. 305,342 | 1/1990 | Magnuson | D21/2 |
| 1,831,230 | 11/1931 | Copas | 124/22 |
| 2,367,249 | 1/1945 | Walker | 124/17 |
| 2,808,043 | 10/1957 | Lombard | 124/22 X |
| 2,820,444 | 1/1958 | Pedersen | 124/20.1 |
| 2,823,483 | 2/1958 | Malott | 124/20 R |
| 3,101,704 | 8/1963 | McCormick | 124/20 R |
| 3,277,878 | 10/1966 | Pankratz | 124/20 R |
| 3,299,564 | 1/1967 | Quercetti | 124/20.1 |
| 3,974,820 | 8/1976 | Ott | 124/20 R |
| 4,050,438 | 9/1977 | Pfotenhauer | 124/20 R |
| 4,050,439 | 9/1977 | Rudy | 124/20.1 |
| 4,240,396 | 12/1980 | Randoll | 124/17 |

*Primary Examiner*—Peter M. Cuomo

[57] ABSTRACT

A game apparatus for throwing aerial projectiles such as water balloons, baseballs, etc., into the air, the preferred embodiment being substantially a plastic ring connected to a pouch by multiple elastic thrust bands, with the pouch being held to the ground by a foot strap and the ring being positioned in front of and over the head of the user, whereby, when the foot strap is released, the projectile is hurled through the center of the ring into the air.

18 Claims, 4 Drawing Sheets

Fig 1
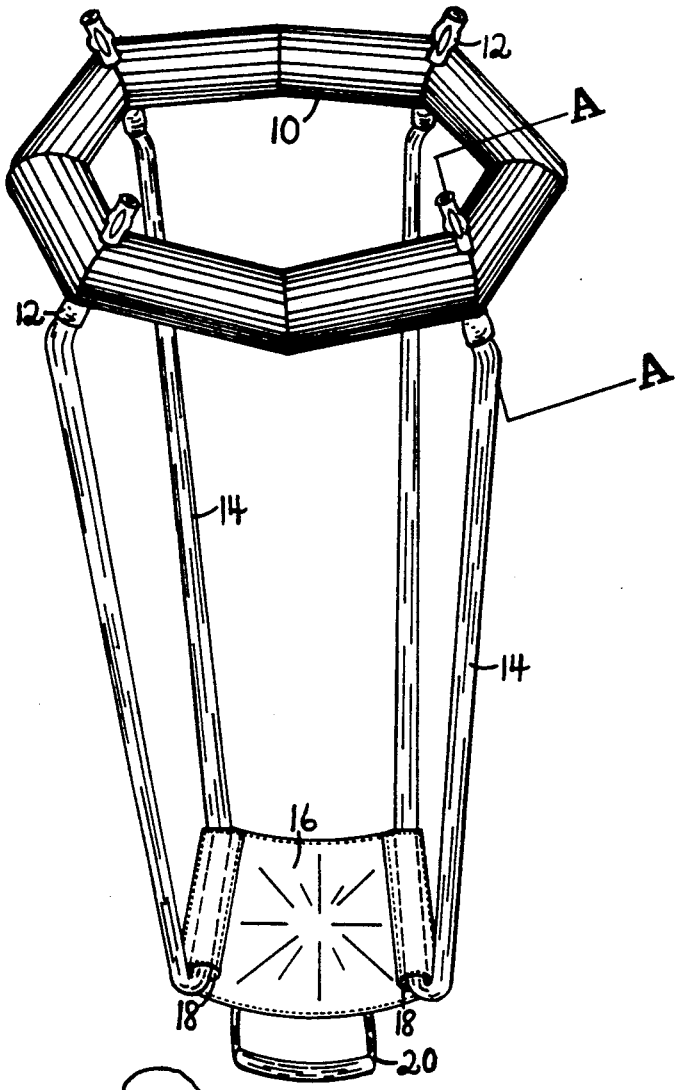
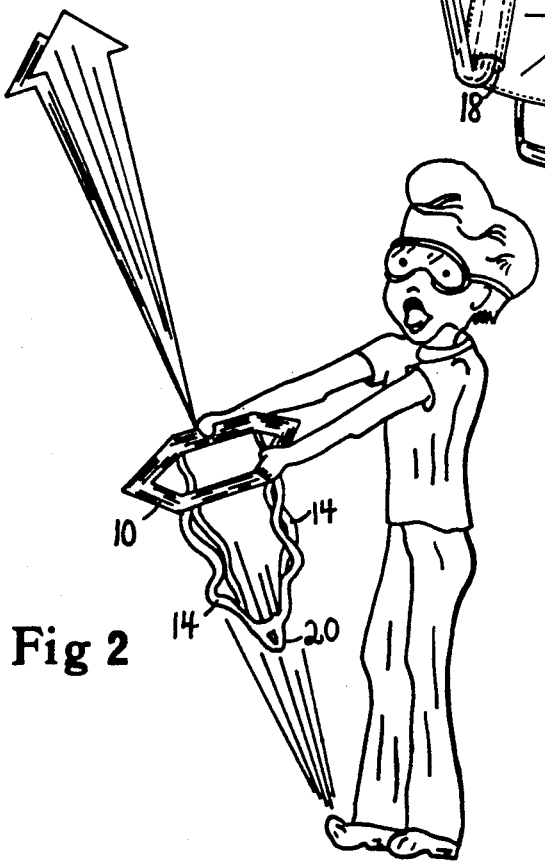
Fig 2
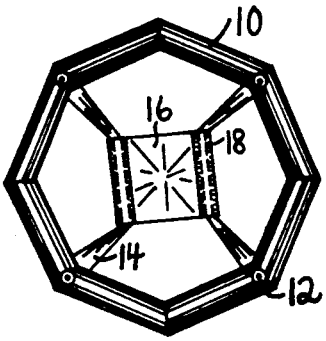
Fig 3

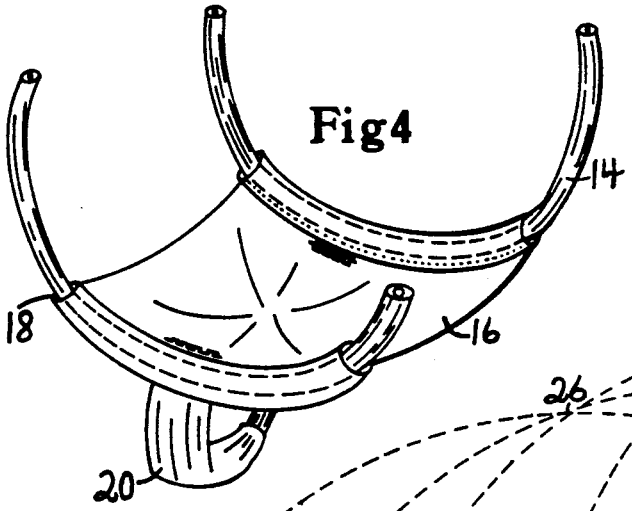
Fig4
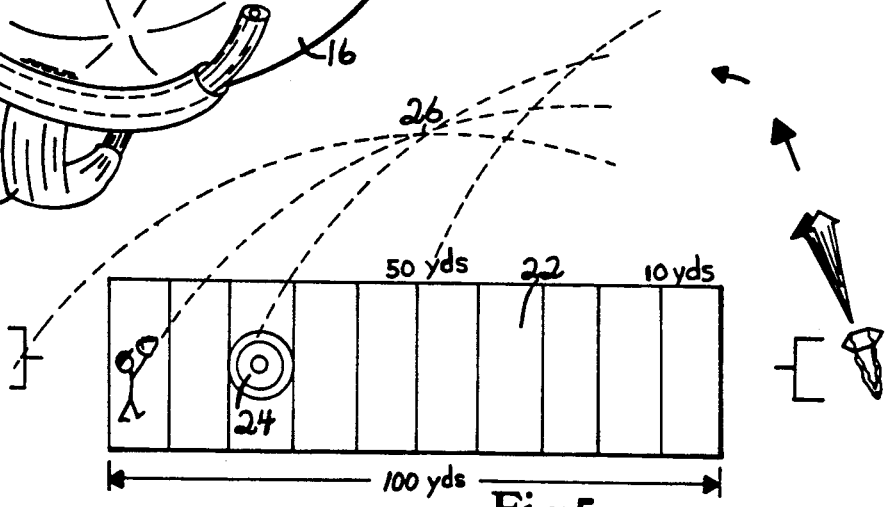
Fig 5
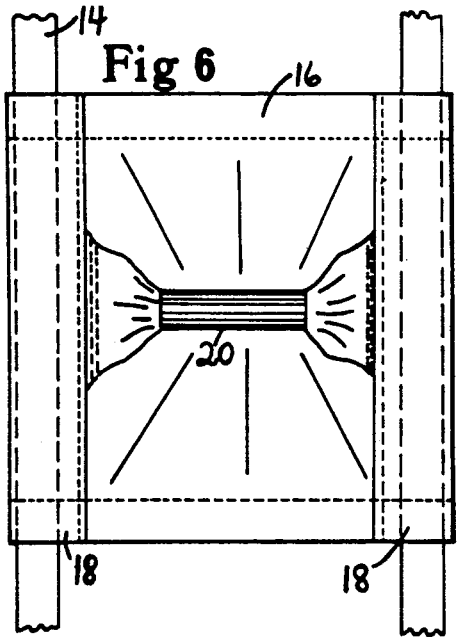
Fig 6
Fig 7
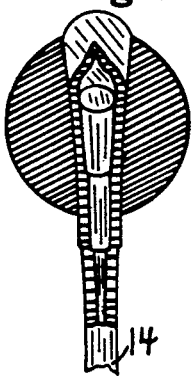
Fig 8
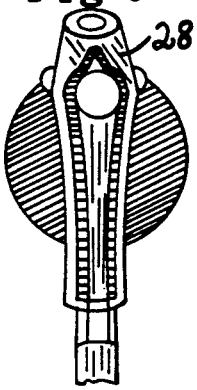

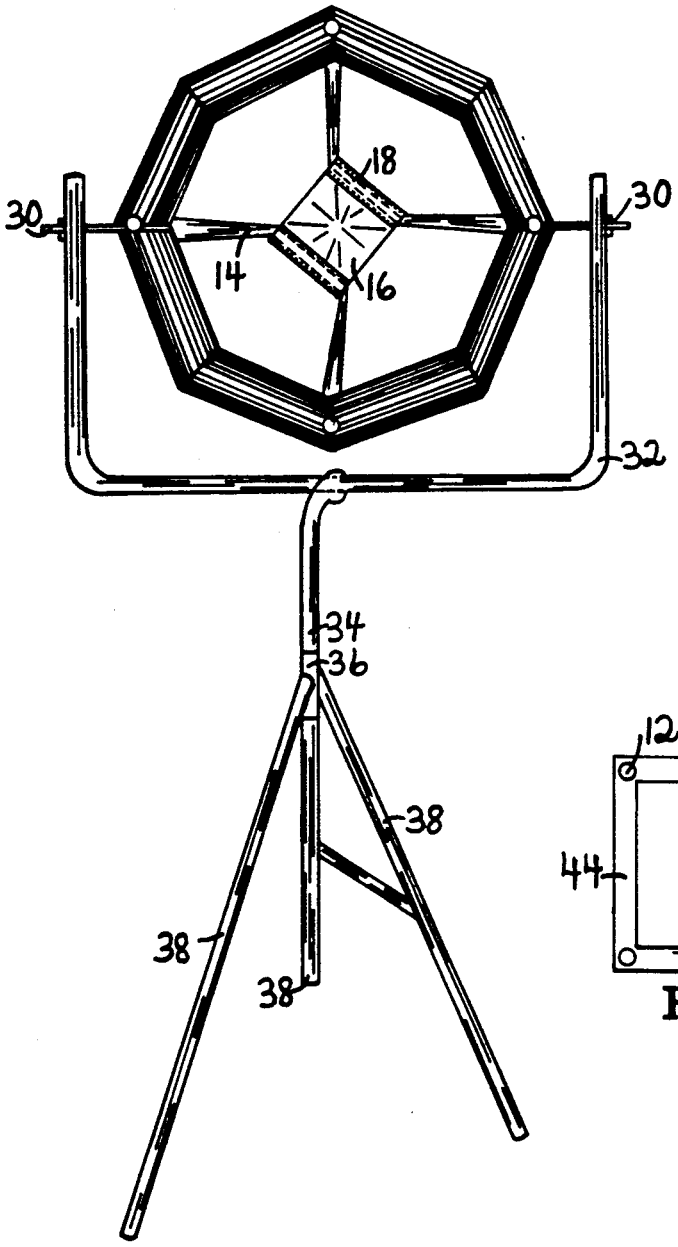
Fig 9
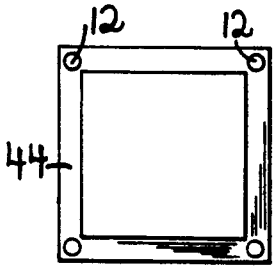
Fig 12-A
Fig 10
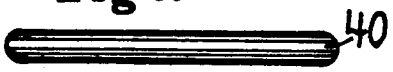
Fig 11
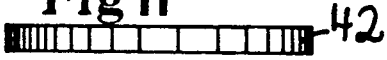
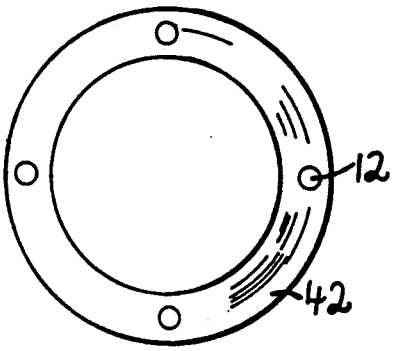
Fig 12-B

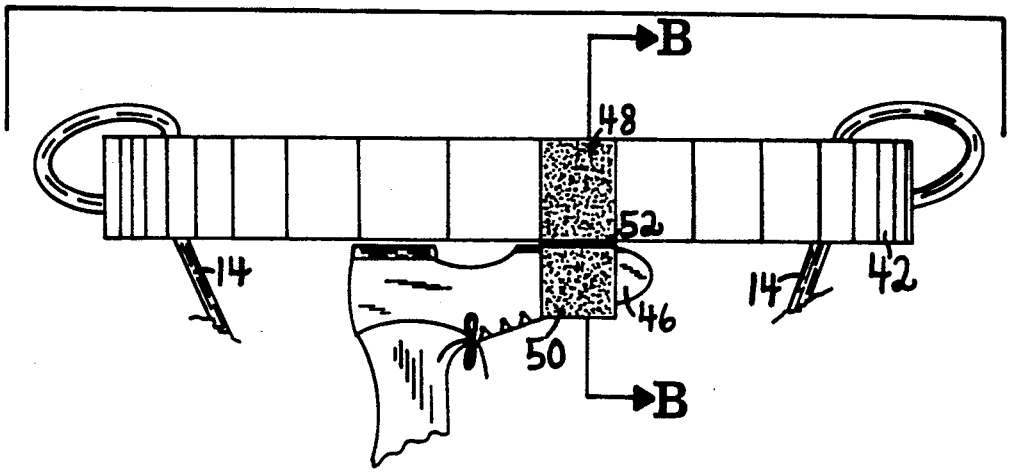
Fig 13
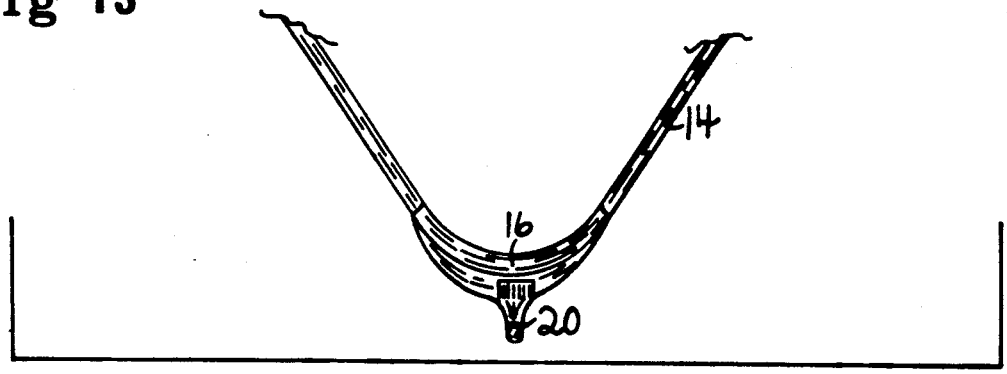
Fig 14
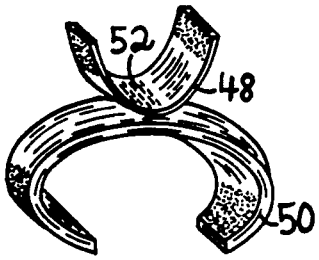
Fig 15
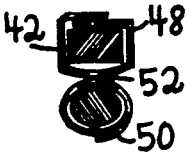

TOESLING GAME-BALLOON AND BASEBALL LAUNCHER

TECHNICAL FIELD

This invention relates to water-balloons or baseball launchers or the like and more particularly to a launcher that is activated by using the foot as well as the hands to activate the elastic members.

BACKGROUND OF THE INVENTION

In the past, a number of devices have been taught which provide means to launch balloons or baseballs or other objects, one being the well known "sling shot" such as U.S. Pat. No. 3,101,704 which is basically a fork with a handle and two elastic bands attached to the fork providing the propelling means.

Also the baseball throwing machine of U.S. Pat. No. 3,277,878 teaches a complicated device envolving pulleys and a substantially large framework which supports the device which has a number of working parts.

U.S. Pat. No. 4,240,396 also shows a device for launching a balloon which is a large device requiring at least three persons to operate.

While the prior art shows means to launch balloons, baseballs or the like, most of them are limited by the reach of the arms or in the case of large launchers, requires several persons to operate them. The present invention addresses these and other problems with the principal improvement being the interaction of using the foot or toe as the releasing member which allows the device to be stretched over the head of the person doing the launching, therefore, resulting in a far greater stretch than has been previously available.

OBJECTS AND ADVANTAGES

It is a primary object, therefore, of the present invention to provide a device which may safely launch a water-balloon, baseball or other object farther than a hand held launcher which is limited by the reach of the arms, by providing a launcher which uses both the feet, arms and hands to provide a longer stretch.

It is a further object to provide substantially a ring to which multiple elastic members may be attached to provide additional force to launch the objects, the objects being launched through the center of the ring.

Still another object is to provide in a second embodiment means to attach the ring to the feet of a person lying on their back which allows the person to launch the objects from a prone position.

Yet another object is to provide a tri-pod arrangement which allows the operator to more directionally hurl or aim objects, such as on a baseball diamond.

SUMMARY OF THE INVENTION

In accordance with the preferred embodiment of the present invention, a substantially ring shaped base is provided to which is suitably attached multiple, elastic members with their distal ends suitably affixed to a pouch or pocket member, with the pouch or pocket member having toe or foot gripping means such as a strap, to enable the operator to engage and hold the pouch or pocket with his foot and the elastic members being of sufficient length to allow the operator to hold the ring in front of and substantially over their head, which tensions the devise and when the pouch or pocket is released by relaxing their toe or foot, the object in the pouch or pocket is hurled through the ring with a force sufficient to throw an object, such as a baseball, a substantial distance such as to the outfield of a baseball diamond.

Other objects and advantages will become apparent when taken into consideration with the following drawings and specifications.

BRIEF DESCRIPTION OF THE DRAWINGS

FIG. 1 is a perspective view of the present invention with an octagonal substantially round tubular base.

FIG. 2 is a schematic view which shows how the device is used.

FIG. 3 is a top view of the present invention.

FIG. 4 is a perspective view of a pouch and toe strap.

FIG. 5 is a schematic view of action indicating some manners of use.

FIG. 6 is a bottom view of a pouch with toe strap attached.

FIG. 7 is a section taken at A—A of FIG. 1 showing a cone plug as a retaining means.

FIG. 8 is a section taken at A—A of FIG. 1 of an optional plug for prolonged life of elastic tubular thrust bands.

FIG. 9 is a perspective view of the device when mounted on a tri-pod.

FIG. 10 is a side view of a rounded tubular base.

FIG. 11 is a side view of a square-cut round base, cut from a pre-formed plastic pipe.

FIG. 12-A is a top view of a square four-sided ring.

FIG. 12-B is a top view of FIG. 11.

FIG. 13 is a plan view showing the device being used in an inverted position and attached to the foot.

FIG. 14 is a perspective view showing the preferred embodiment of attaching a base to the feet, but shown in an open position.

FIG. 15 is a section taken at B—B of FIG. 13 showing the preferred embodiment of attaching a base to the feet, but shown in a closed position

DETAILED DESCRIPTION OF THE DRAWINGS

Referring now to the details wherein like numerals represent like parts throughout the various views, 10 is a octagonal substantially round tubular base with 12 being mounting holes for elastic tubular thrust bands 14, elastic tubular thrust bands 14, being of a sufficient length to allow the user to stretch them substantially from the ground to a position which places the base into a position in front of and above the head while 16 is a pouch or pocket containing sleeves 18 which capture elastic tubular thrust bands 14 with 20 being a foot or toe strap suitably affixed to the pouch or pocket 16.

22 is a typical playing field showing a target 24 with 26 being a possible projectile path of the balloon or baseball or the like. 26 is a cone plug inserted into elastic tubular thrust bands 14 and acts as a retaining means while 28 is an optional protective sleeve for prolonged life of the elastic tubular thrust bands.

A second embodiment shows the present invention being mounted by pivotable mounts 30 to a yoke 32 which is affixed to upright 34, upright 34 being pivotable in a housing 36 which is suitably attached to tri-pod 38. It will be understood that the base 10 may take a number of forms and shapes such as the round tubular embodiment 40 shown in FIG. 10 or the round square-cut embodiment 42 shown in FIG. 11 and 12-B or the substantially square tubular base 44 shown in FIG. 12-A.

Yet another embodiment shows the foot 46 of the user being attached to one of the bases such as the square-cut base 42 by a hook and pile fastener such as VELCRO 48 and 50 being affixed together by means such as stitching 52.

It will now be seen that we have provided a game apparatus for throwing aerial projectiles such as water balloons, baseballs or the like. The game apparatus consists of a ring which can take several shapes and may be held comfortably with two hands, a pouch to capture and hold the projectiles with a plurality of elastic thrust bands that connect the ring, pouch and a foot strap affixed to the back of the pouch for the insertion of at least one toe, so that when the pouch is held to the ground by the toe and strap, the ring is positioned in front of and above the user so that when the toe releases the strap the now tensioned elastic thrust bands hurl the projectile through the ring in a forceful manner into the air.

It shall also be seen that we have provided an apparatus which can be attached to a tri-pod frame support which pivots and turns giving a wider range of launching angles, distances and uses.

It will further be seen that we have provided a game apparatus with its principle part being a ring which may be formed by injection molding or cut from pre-formed plastic such as a plastic pipe, while the elastic thrust bands may be made from rubber tubing such as surgical tubing, while the pouch may be fabricated by sewing from cloth or leather material.

It will further be seen that we have provided a game apparatus which may be used in a prone position for example when the user lies flat on their back they simply place their feet on the ring portion of the apparatus and attach by way of VELCRO straps, then grasp the toe-strap (in this position it may be called a hand strap) and stretch the elastic thrust bands until the desired tension is achieved, whereby, when the hand strap is released the aerial projectile is hurled through the ring in a forceful manner into the air.

It will also be seen that we have provided a game device which enables the user to launch a aerial projectile such as a water-balloon, baseball or the like farther than any previous hand-held launchers which are limited by reach of the arms. The present invention uses both the feet and the arms to provide a longer stretch.

It will further be seen that we have provided a game device which increases the force applied to the projectile, therefore, encouraging the projectile to travel farther.

It will also be seen that we have provided a game device which is simple, fun and safe to use.

Although the invention has been herein shown and described in what is conceived to be the most practical and preferred embodiments, it is recognized that departures may be made therefrom within the scope of the invention, which is not to be limited to the details disclosed herein but it is to be accorded the full scope of the claims so as to embrace any and all equivalent devices and apparatus.

Having described our invention, what we claim as new and desire to secure by letters patent is:

1. A game apparatus for throwing aerial projectiles comprising; a base, said base being substantially in the form of a ring, said ring being of a size and shape to be comfortably held between two hands, a plurality of elastic thrust bands, means to affix said thrust bands to said ring, a pouch, means to affix said thrust bands to said pouch, strap means secured to said pouch to releaseably hold and capture at least one toe of one foot to said pouch, said base, said ring, said elastic thrust bands, said pouch and said strap means to releaseably hold at least one toe to said pouch, cooperating together to form a sling capable of holding an aerial projectile placed in said pouch, whereby, when said toe holds said pouch to the ground and said ring is held in front of and above the user, said thrust bands are stretched into a tensioned position and when said toe releases said pouch, said aerial projectile is hurled through said ring in a forceful manner into the air.

2. The device of claim 1 in which said base is in the form of a octagonal substantially round tubular ring.

3. The device of claim 1 in which said base is in the form of a square-cut ring cut from a pre-formed plastic pipe.

4. The device of claim 1 in which said base is in the form of a square four-sided ring.

5. The device of claim 1 in which said elastic thrust bands are rubber tubing.

6. The device of claim 5, in which said rubber tubing is surgical tubing.

7. The device of claim 1 in which said means to affix said thrust bands to said ring is a plurality of holes in said ring, said holes accepting an end of said thrust bands, a plurality of cone plugs, said cone plugs cooperating with said thrust bands and said holes to affix said thrust bands to said ring.

8. The device of claim 1 in which said means to affix said thrust bands to said ring is a plurality of holes in said ring, a plurality of protective sleeves, said sleeves capturing said thrust bands, a plurality of balls, said balls being of a size to fit into said thrust bands, said sleeves, said balls, said thrust bands, and said holes cooperating together to affix said thrust bands to said ring.

9. The device of claim 1 in which said means to affix said thrust bands to said pouch is sleeves in said pouch capable of capturing and holding said thrust bands.

10. The device of claim 1 in which said strap means to releaseably hold and capture at least one toe of one foot to said pouch is a single strap.

11. The device of claim 1 in which said ring of said game apparatus is further mounted in a supporting yoke, said yoke being mounted on a tri-pod, said game apparatus, said yoke and said tri-pod cooperating together to allow the game apparatus to be aimed in any aerial position, whereby the projectile may be hurled toward a pre-determined target.

12. The device of claim 1 in which said game apparatus is further equipped with means to attach said ring to the feet of the user while the user lies in a prone position which allows the user to grasp the said means to hold said toe, on said pouch, whereby, the user can now pull the said elastic thrust bands to a tensioned position and when released, said aerial projectile is hurled through said ring in a forceful manner into the air.

13. The device of claim 12 in which said means to attach said ring to said feet of the use is by a hook and pile fastener such as VELCRO.

14. The device of claim 1 in which said ring is made of POLYETHYLENE.

15. The device of claim 1 in which said ring is made from rings cut from pre-formed POLYETHYLENE pipe.

16. A method of launching an aerial projectile by one person using a launcher having a base, said base being substantially in the form of a ring, a plurality of elastic thrust bands secured to said ring, a pouch secured to said thrust bands and having a toe strap comprising the steps of;

(a) placing said projectile into said pouch
(b) grasping said ring with both hands;
(c) placing at least one toe in said toe strap;
(d) holding said strap to the ground with said toe;
(e) stretching said elastic thrust bands to a position where said ring is held in front of and above the user;
(f) aligning said elastic thrust bands in a direction substantially parallel to the desired trajectory of the aerial projectile and;
(g) releasing the tension on said toe, whereby, said toe strap slips off of said toe, launching said aerial projectile through said ring.

17. A method of launching an aerial projectile by one person using a launcher having a base, said base being substantially in the form of a ring, said ring having means to be attached tot he feet of the user, a plurality of elastic thrust bands secured to said ring, a pouch secured to said thrust bands and a strap suitably affixed to said pouch, comprising the steps of;

(a) the user lying on his back on the ground;
(b) attaching both feet to said feet attaching means;
(c) grasping said strap affixed to said pouch;
(d) placing an aerial projectile into said pouch;
(e) extending legs to stretch said elastic thrust bands;
(f) aligning said elastic thrust bands in a direction substantially parallel to the desired trajectory of the aerial projectile and;
(g) releasing said strap to launch said aerial projectile through said ring.

18. A method of launching an aerial projectile by one person using a launcher having a base, said base being substantially in the form of a ring, said ring being mounted in a yoke, said yoke being pivotably supported by a tri-pod, said tri-pod having means to be secured to the ground, a plurality of elastic thrust bands secured to said ring, a pouch secured to said thrust bands, a strap suitably affixed to said pouch comprising the steps of;

(a) securing the tri-pod to the ground;
(b) placing an aerial projectile into said pouch;
(c) grasping the strap affixed to said pouch;
(d) placing an aerial projectile into said pouch;
(e) aligning said yoke, said elastic thrust bands and said ring in a manner to aim said aerial projectile in a desired trajectory and;
(f) releasing said strap to launch said aerial projectile through said ring.

* * * * *